United States Patent [19]

Lancaster

[11] Patent Number: 4,761,934

[45] Date of Patent: Aug. 9, 1988

[54] PARALLEL BELTED CLAMP

[75] Inventor: William G. Lancaster, Louisville, Ky.

[73] Assignee: Lantech, Louisville, Ky.

[21] Appl. No.: 19,613

[22] Filed: Feb. 27, 1987

[51] Int. Cl.[4] ..... B65B 13/04

[52] U.S. Cl. ..... 53/399; 53/441; 53/556; 53/588; 83/382; 83/456; 269/139; 269/164

[58] Field of Search ..... 53/556, 588, 210, 399, 53/450; 269/164, 234, 139; 83/382, 456; 100/13, 27

[56] References Cited

U.S. PATENT DOCUMENTS

| | | | |
|---|---|---|---|
| 2,133,305 | 10/1938 | Payne | 269/234 X |
| 2,381,584 | 8/1945 | Fullerton | 269/234 |
| 2,630,751 | 3/1953 | Cranston | 53/588 X |
| 4,110,957 | 9/1978 | Lancaster | 53/588 X |
| 4,210,043 | 2/1980 | Urion | 83/456 X |
| 4,317,322 | 3/1982 | Lancaster | 100/13 |
| 4,356,685 | 11/1982 | Buttner | 53/588 |
| 4,545,182 | 10/1985 | McDowell | 53/588 X |

FOREIGN PATENT DOCUMENTS

| | | | |
|---|---|---|---|
| 366119 | 3/1973 | U.S.S.R. | 269/234 |

*Primary Examiner*—John Sipos

*Attorney, Agent, or Firm*—Finnegan, Henderson, Farabow, Garrett & Dunner

[57] ABSTRACT

A clamp for clamping a web during stretch wrapping includes a first longitudinally extending clamp element for engaging the web, a second longitudinally extending clamp element extendable in a direction generally parallel to the longitudinal direction of the first clamp element for clamping the web between the second clamp element and the first clamp element as the second clamp element is longitudinally extended in a direction parallel to the longitudinal direction of the first clamp element.

50 Claims, 4 Drawing Sheets

PARALLEL BELTED CLAMP

BACKGROUND OF THE INVENTION

The present invention relates to methods and apparatus for clamping and more particularly relates to methods and apparatus for clamping a web and wrapping a load with the web.

A wide variety of clamping devices have been developed to accommodate the specialized needs of operations in diverse fields. Such developments have specifically occurred in the field of stretch wrapping, which involves the process of wrapping a load with a web of stretchable material. As stretch wrapping technology developed and became increasingly automated, clamping arrangements were developed which accommodated and complemented the other features of the operation. Examples of such clamping arrangements for stretch wrapping machines are shown in U.S. Pat. Nos. 4,232,501 and 4,300,326 to Stackhouse and 4,317,322 to Lancaster et al., all of which are assigned to Lantech, Inc., and incorporated herein by reference.

Although successful, these arrangements have limitations in positioning and control during the operation of the stretch wrapping equipment.

Accordingly, it is the object of the present invention to provide a clamping arrangement which has less restrictive limitations in positioning and control during stretch wrapping operations than previously known arrangements.

In particular, it is an object of the present invention to provide a clamping arrangement which minimizes lateral movement of the clamp during operation and the space required for such movement.

It is another object of the present invention to provide a clamping arrangement which easily orients itself to the work piece which is clamped.

It is an additional object of the present invention to provide a clamping arrangement which can be easily positioned and removed from a work location without interfering with the other operations of the apparatus.

It is a further object of the present invention to provide a clamping arrangement which smoothly secures a work piece without causing damage.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a clamp comprising a first longitudinally extending clamp means for engaging a workpiece; a second longitudinally extending clamp means extendable in a direction parallel to the longitudinal direction of the first clamp means for clamping a workpiece between the second clamp means and the first clamp means as the second clamp means is longitudinally extended in a direction parallel to the longitudinal direction of the first clamp means. It is preferable that the second clamp means is extendable relative to the first clamp means for clamping the workpiece between the second clamp means and the first clamp means. It is further preferable that the clamp includes a base means for supporting and cantilevering the first and second clamp means, the first clamp means extendable relative to the base and the second clamp means for receiving a workpiece.

It is also preferable that the first clamp means includes first contact means for contacting the workpiece, and the second clamp means includes second contact means opposed to the first contact means for contacting the workpiece, the second contact means being supported by the remaining portion of the second clamp means and movable relative to the remaining portion of the second clamp means while being fixed relative to the first contact means for clamping the workpiece between the first contact means and the second contact means. It is further preferable that the first and second contact means sequentially and continuously clamp the workpiece across a section of the workpiece. It is also preferable that at least one of the first and second contact means is a belt.

It is also preferable that the clamp includes cutting means mounted near the cantilevered end of the second clamp means for cutting the workpiece while clamping the workpiece. It is additionally preferable that the clamp includes wipe down means mounted proximate to the cantilevered end of the second clamp means for wiping down the workpiece while clamping the workpiece.

In further accordance with the purposes of the invention, there is provided apparatus for clamping a web and wrapping a load with a web comprising: means for dispensing the web; means for rotating the load relative to the dispenser means to wrap the web on the load; and means for clamping the web including a first longitudinally extending clamp means for engaging the web, a second longitudinally extending clamp means extendable in a direction generally parallel to the longitudinal direction of the first clamp means for clamping the web between the second clamp means and the first clamp means as the second clamp means is longitudinally extended in a direction parallel to the longitudinal direction of the first clamp means.

Also in accordance with the purposes of the invention there is provided a method of wrapping a load with a web comprising: positioning a load in a position to be wrapped; rotating the load relative to a web dispenser to wrap the web on the load; extending a first longitudinally extending clamp element along its longitudinal direction into the wrapping path of the web; passing the web over the first clamp element; extending a second longitudinally extending clamp element along its longitudinal direction in a direction parallel to the first clamp element to clamp the web between the first and second clamp elements as the second clamp element is longitudinally extended in a direction parallel to the longitudinal direction of the first clamp element.

BRIEF DESCRIPTION OF THE DRAWINGS

The accompanying drawings, which are incorporated in and constitute part of the specification, illustrate a presently preferred embodiment of the invention and, together with the general description given above and the detailed description of the preferred embodiment given below, serve to explain the principles of the invention.

DESCRIPTION OF THE PREFERRED EMBODIMENTS

Reference will now be made in detail to the present preferred embodiment of the invention as illustrated in the accompanying drawings.

In accordance with the present invention there is provided a clamp comprising: a first longitudinally extending clamp means for engaging a workpiece; a second longitudinally extending clamp means extendable parallel to the longitudinal direction of the first clamp means for clamping a workpiece between the second clamp means and the first clamp means as the second clamp means is longitudinally extended in a direction parallel to the longitudinal direction of the first clamp means. It is preferable that the second clamp means is extendable relative to the first clamp means and that a base means is included for supporting and cantilevering the first and second clamp means.

Figure 1:
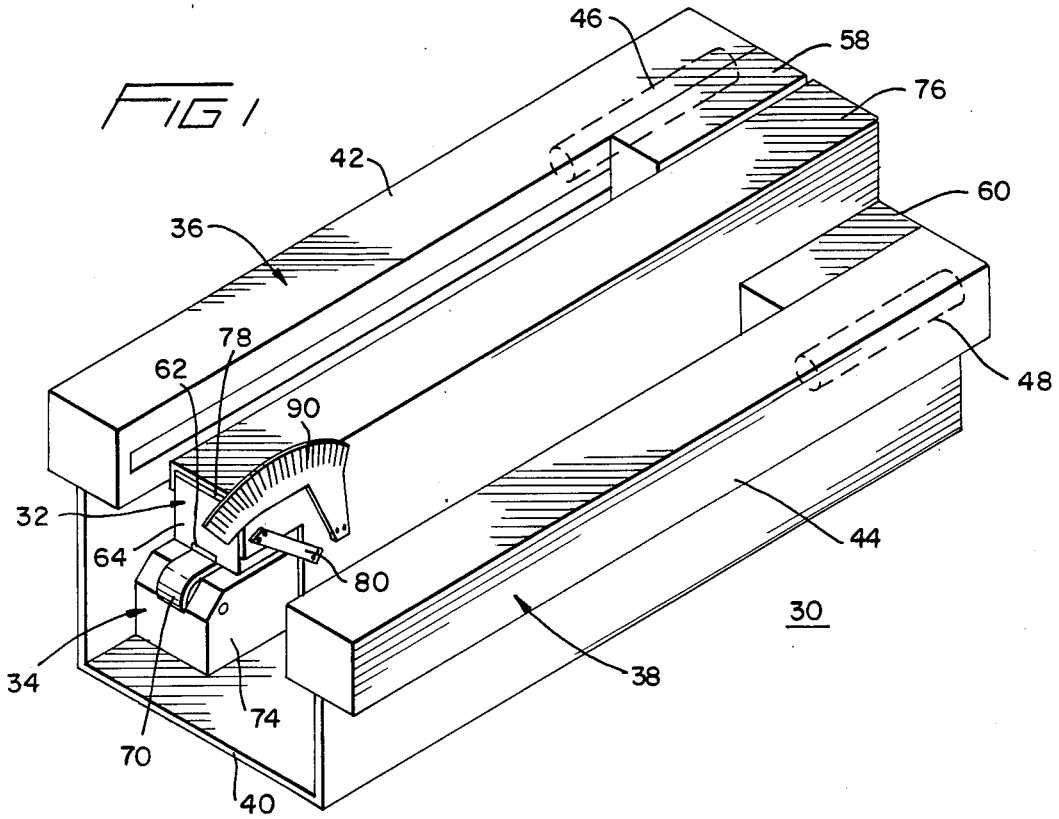
FIG. 1 is a perspective view of a clamp incorporating the teachings of the present invention.

As shown and embodied in FIG. 1, there is provided a clamp 30. The first longitudinally extending clamp means is a first rigid longitudinally extending clamp bar 32 which is a slender member. The second longitudinally extending clamp means includes a second longitudinally extending clamp bar 34 which is a slender member that extends generally parallel to the longitudinal extent of the first clamp bar 32. The base means includes a first rodless cylinder 36 and a second rodless cylinder 38. Both rodless cylinders 36 and 38 are connected to a rigid frame 40 which supports and fixes both rodless cylinders 36 and 38 relative to the ground during operation.

Rodless cylinders, in and of themselves, are known, commercially available devices which may be obtained from manufacturers such as Tol-0-Matic or Origa. Although rodless cylinders are currently preferable, the use of traditional piston and cylinder arrangements, as well as other motive systems, are within the scope of the invention. Rodless cylinders 36 and 38 include respective outer housings 42 and 44 which are secured to frame 40, pistons 46 and 48 which are selectively powered and movably positioned along the longitudinal length of outer housings 42 and 44.

Piston 46 of first rodless cylinder 36 is attached to first clamp bar 32 through an intermediate support 58. Likewise, piston 48 of second rodless cylinder 38 is connected to second clamp bar 34 through an intermediate support 60. In such a manner, the first rodless cylinder 36 is used to support, as well as longitudinally extend and retract first clamp bar 32. Likewise, second rodless cylinder 38 is used to support, as well as longitudinally extend and retract second clamp bar 34 in a direction parallel to the longitudinal extent of the first clamp bar 32. Clamp bars 32 and 34 are cantilevered by rodless cylinders 36 and 38 because they are only attached to rodless cylinders 36 and 38 at one of the respective ends. Clamp bars 32 and 34 are independently extendable relative to each other and are also simultaneously extendable relative to rodless cylinders 36 and 38.

According to the present invention, the first clamp means includes first contact means for contacting the workpiece, and the second clamp means includes second contact means opposed to the first contact means for contacting the workpiece, the second contact means being supported by the remaining portion of the second clamp means and movable relative to the remaining portion to the second clamp means while being fixed relative to the first contact means for clamping the workpiece between the first contact means and the second contact means.

Figure 2:
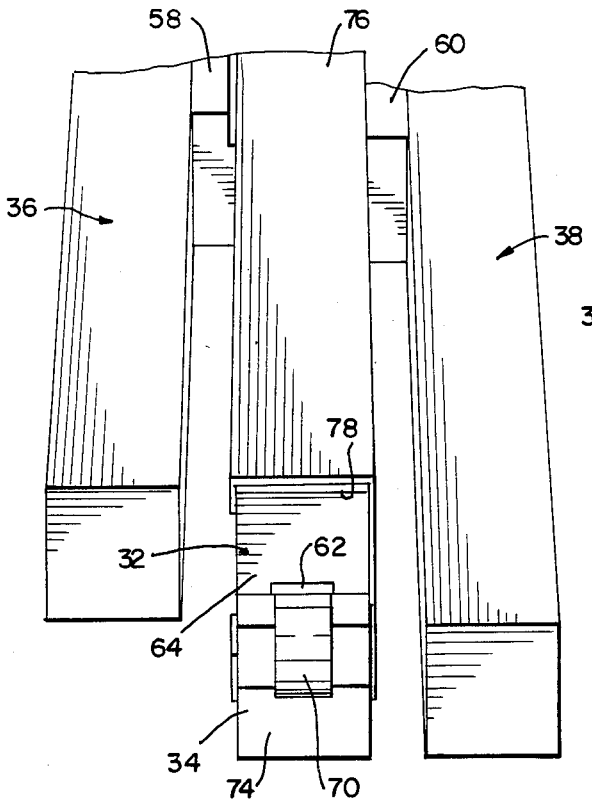
FIG. 2 is a front end perspective view of the clamp illustrated in FIG. 1 without a wipedown brush.

As shown and embodied in FIGS. 1 and 2, and 4 A–E the first contact means is a contact strip 62 of resilient material. The remaining portion of the first clamp means is the remaining portion 64 of the first clamp bar 32, namely, a metal bar with a longitudinally running groove. Contact strip 62 is affixed in the longitudinally running groove of remaining portion 64 of first clamp bar 32. Therefore, it is seen that the remaining portion of the first clamp means is the portion of the first clamp means other than the first contact means.

Figure 3:
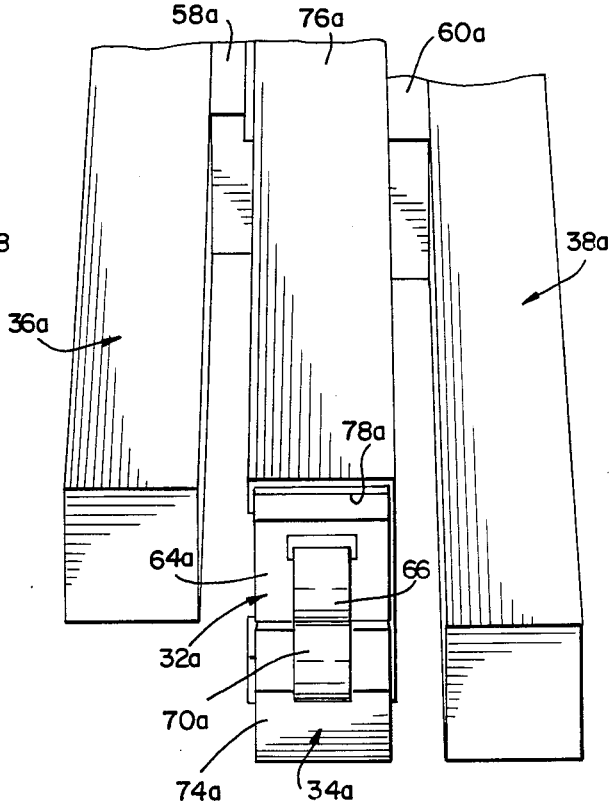
FIG. 3 is a front end perspective view of a second embodiment of a clamp according to the teachings of the present invention.
Figure 5A:
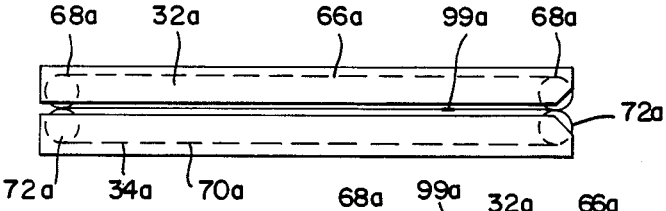
FIGS. 5A–5C are schematic left side views of the embodiment shown in FIG. 3 executing another embodiment of a method incorporating the teachings of the present invention.
Figure 5B:
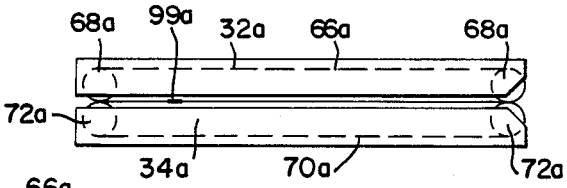
Figure 5C:
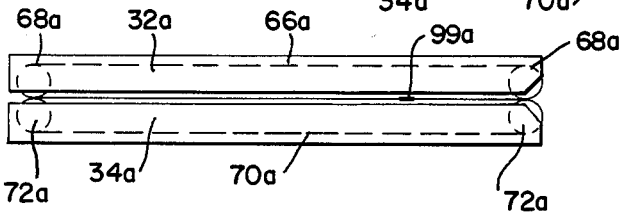

As shown and alternatively embodied in FIGS. 3 and 5 A–C, the first contact means is a belt 66*a* which passes around pulleys 68*a* at the ends of first clamp bar 32*a*. The remaining portion of the first clamp means is the remaining portion 64*a* of the first clamp bar 32*a*, namely, a metal bar with a longitudinally running slot. Pulleys 68*a* and belt 66*a* are positioned in the longitudinally running slot of remaining portion 64*a* of first clamp bar 32*a* so that belt 66*a* is longitudinally movable relative to the remaining portion 64*a* of first clamp bar 32*a*. Therefore, it is seen that the remaining portion of the first clamp means is the portion of the first clamp means other than the first contact means.

In the embodiment of FIGS. 1, 2, and 4 A–E, the second contact means includes an endless belt 70 which passes around pulleys 72. The remaining portion of the second clamp means is the remaining portion 74 of second clamp bar 34, namely, a metal bar with a longitudinally running slot. Pulleys 72 and belt 70 are positioned in and supported by the remaining portion 74*a* of second clamp bar 34*a*. Therefore, it is seen that the remaining portion of second clamp means is the portion of the second clamp means other than the second contact means. Belt 70 is movable along the longitudinal length of second clamp bar 34 relative to the remaining portion 74 of the second clamp bar 34 while being fixed relative to contact strip 62.

In the embodiment of FIGS. 3 and 5 A–C, the second contact means includes an endless belt 70*a* which passes around pulleys 72*a*. The remaining portion of the second clamp means is the remaining portion 74*a* of the second clamp bar 34*a*, namely, a metal bar with a longitudinally running slot. Pulleys 72*a* and belt 70*a* are positioned in and supported by the remaining portion 74a of second clamp bar 34a. Therefore, it is seen that the remaining portion of second clamp means is the portion of the second clamp means other than the second contact means. Belt 70a is movable along the longitudinal length of second clamp bar 34a relative to the remaining portion 74a of the second clamp bar 34a while being fixed relative to belt 66a.

In the embodiment of FIGS. 1, 2 and 4 A–E, and shown in FIG. 4 A–E, a portion 75 of belt 70 is attached to the first clamp bar 32 to allow the opposing portion of belt 70 to be fixed relative to contact strip 62 at all times. In this arrangement, the opposing portion of belt 70 will move relative to remaining portion 74 of second clamp bar 34 when there is relative movement between the remaining portions 64 and 74 of clamp bars 32 and 34.

In the embodiment shown in FIGS. 3 and 5, the opposing portions of belts 66a and 70a have no translational movement relative to each other. Belts 66a and 70a are preferably anchored relative to the ground by an anchor 99 which securely engages both belts at that point so that they undergo no translational movement relative to the ground when the remaining portions 64a and 74a of clamp bars 32 and 34a are moved longitudinally. Alternatively, belts 66a and 70a may be free from the ground and movable only when engaging a workpiece. However, if the clamp is actuated in its intended manner to engage a workpiece which is fixed relative to the ground, it is preferable to anchor belts 66a and 70a to the ground to avoid damaging a fragile workpiece.

As shown in the sequential operations depicted in FIGS. 4 A–E and 5 A–C, the first and second clamp bars 32 and 34 are advanced to engage a workpiece and clamp the workpiece between the opposing contact surfaces of the first and second clamp bars 32 and 34. As such, the first and second contact means sequentially and continuously clamp the workpiece across a section of the workpiece.

According to the present invention, there is provided means for orienting and forcing the first and second clamp means together. It is preferable that the orienting and forcing means is a C-shaped bracket with a portion of the bracket located proximate to the cantilevered end of the second clamp means. It is also preferable that the bracket is secured to the second clamp means and slidable relative to the first clamp means.

As shown and embodied in FIGS. 1 and 3, the means for orienting and forcing the first and second clamp means together includes a C-shaped bracket 76 which extends along most of the length of second clamp bar 34. A portion of bracket 76 is located near the cantilevered end of second clamp bar 34. Bracket 76 is secured to remaining portion 74 of second clamp bar 34, and is slidable relative to first clamp bar 32. A low friction strip 78 is positioned between bracket 76 and first clamp bar 32 to facilitate the sliding action between bracket 76 and first clamp bar 32.

In accordance with the present invention, there is provided cutting means mounted near the cantilevered end of the second clamp means for cutting the workpiece while clamping the workpiece.

Figure 6:
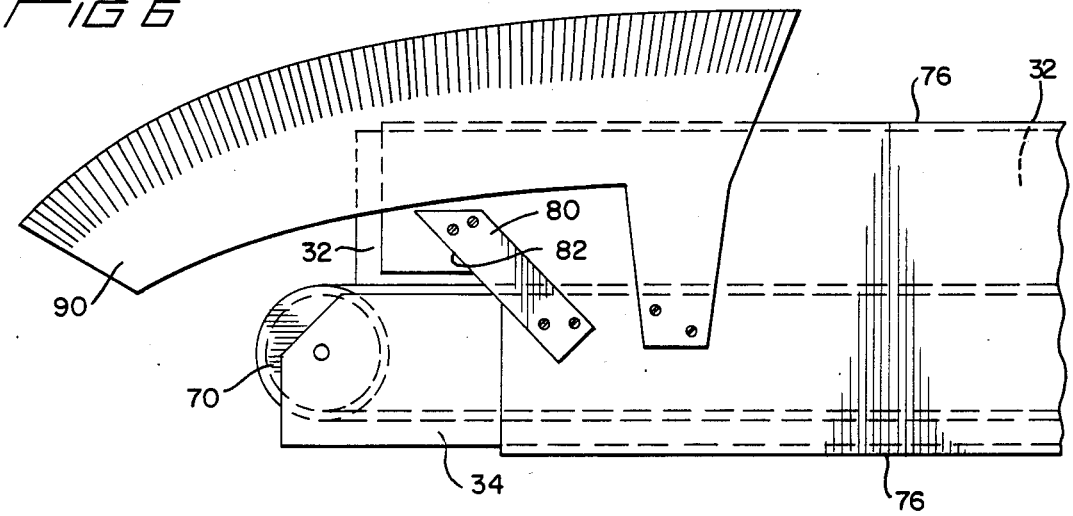
FIG. 6 is a right side elevation view of a portion of the embodiment illustrated in FIG. 1 in a slightly different position.
Figure 7:
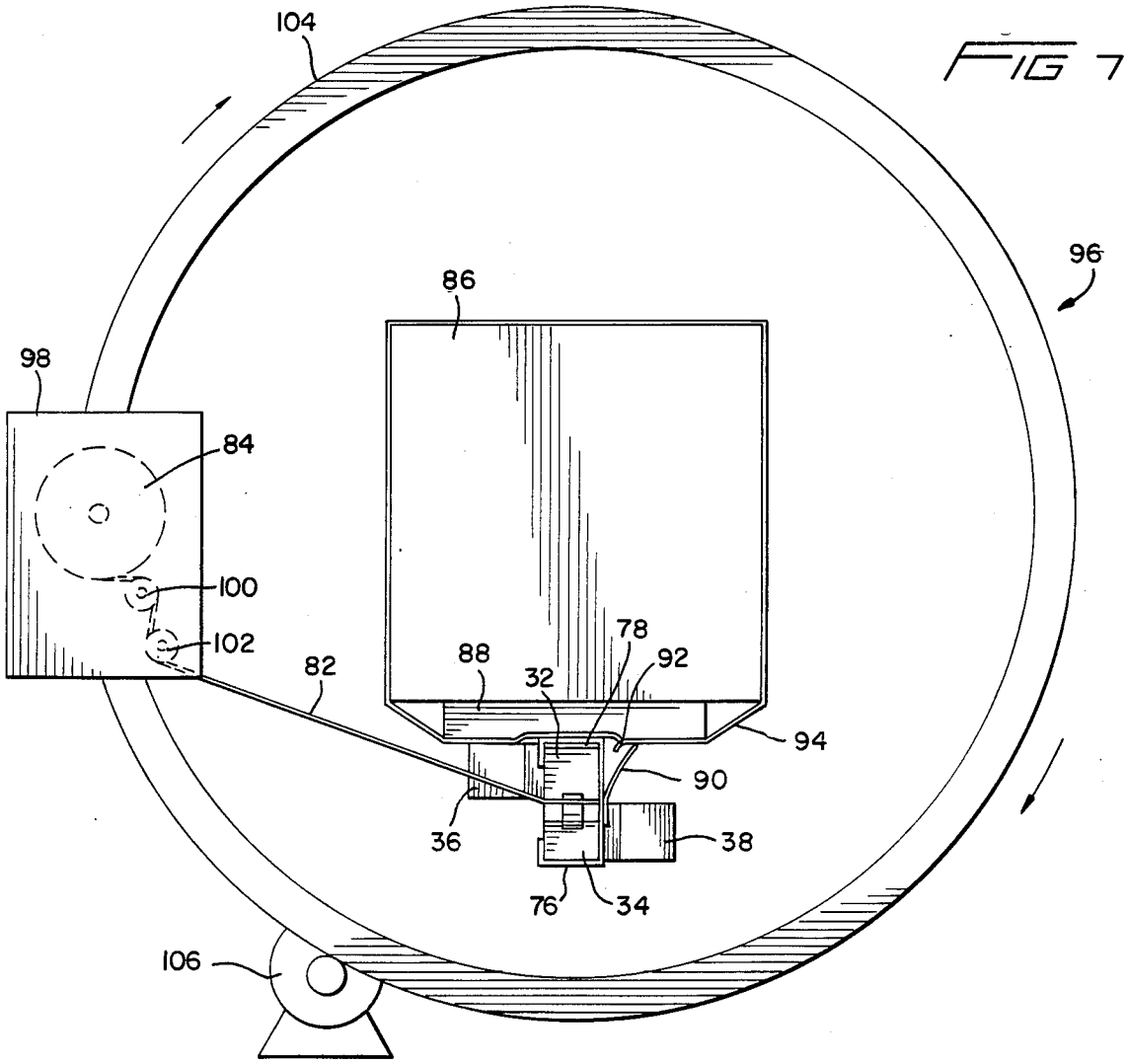
FIG. 7 is a front end section view of an apparatus for clamping a web and wrapping a load with the web, incorporating the teachings of the present invention.

As shown and embodied in FIGS. 1 and 6, the cutting means includes a razor knife blade 80 which is mounted on and moves with bracket 76 and second clamp bar 34. Blade 80 has a sharp edge 82 for cutting the workpiece as second clamp bar 34 is extended while clamping the workpiece in between first clamp bar 32 and second clamp bar 34. As shown and embodied in FIG. 7, the workpiece is a web 82 which is dispensed from a roll 84 to wrap a load 86 which is conveyed into position on a conveyor 88. As shown in FIG. 7 after the cutting step, web 82 remains clamped in first and second clamp bars 32 and 34 after being cut.

In accordance with the present invention, there is provided wipe down means mounted near the cantilevered end of the second clamp means for wiping down the workpiece while clamping the workpiece. As shown and embodied in FIGS. 1, 6 and 7, there is provided a wipedown brush 90 for wiping down the trailing edge portion 92 of the web which has been wrapped around load 86. As a result, trailing edge 92 of the web is smoothed down into an adhered state to a layer of web 94 which has already been wrapped on load 86. The wipedown with brush 90 occurs during the extension of second clamp bar 34 so the clamping, cutting, and wipedown all occurs in one smooth operation.

In accordance with the present invention, there is provided apparatus for clamping a web and wrapping a load with the web comprising: means for dispensing the web; means for rotating the load relative to the dispenser means to wrap the web on the load; and means for clamping the web including a first longitudinally extending clamp means for engaging the web, a second longitudinally extending clamp means extendable in a direction generally parallel to the longitudinal direction of the first clamp means for clamping the web between the second clamp means as the second clamp means is longitudinally extended in a direction parallel to the longitudinal direction of the first clamp means.

As shown and embodied in FIG. 7, there is provided a stretch wrapping apparatus 96 for clamping a web and wrapping a load with the web. The means for dispensing the web includes a web dispenser housing 98 for a rotatably supporting web roll 84 and prestretch rollers 100 and 102. The means for rotating the load relative to the dispenser means to wrap the web on the load includes ring 104 which is rotatably mounted on a frame (not shown) and rotatably driven by a motor 106 in a clockwise direction. Although the web dispenser 98 may be fixed relative to the ground and the load 86 rotated relative to the ground, it is preferable that the load 86 be fixed relative to the ground and that web dispenser 98 move relative to the ground by revolving around the load.

Figure 8:
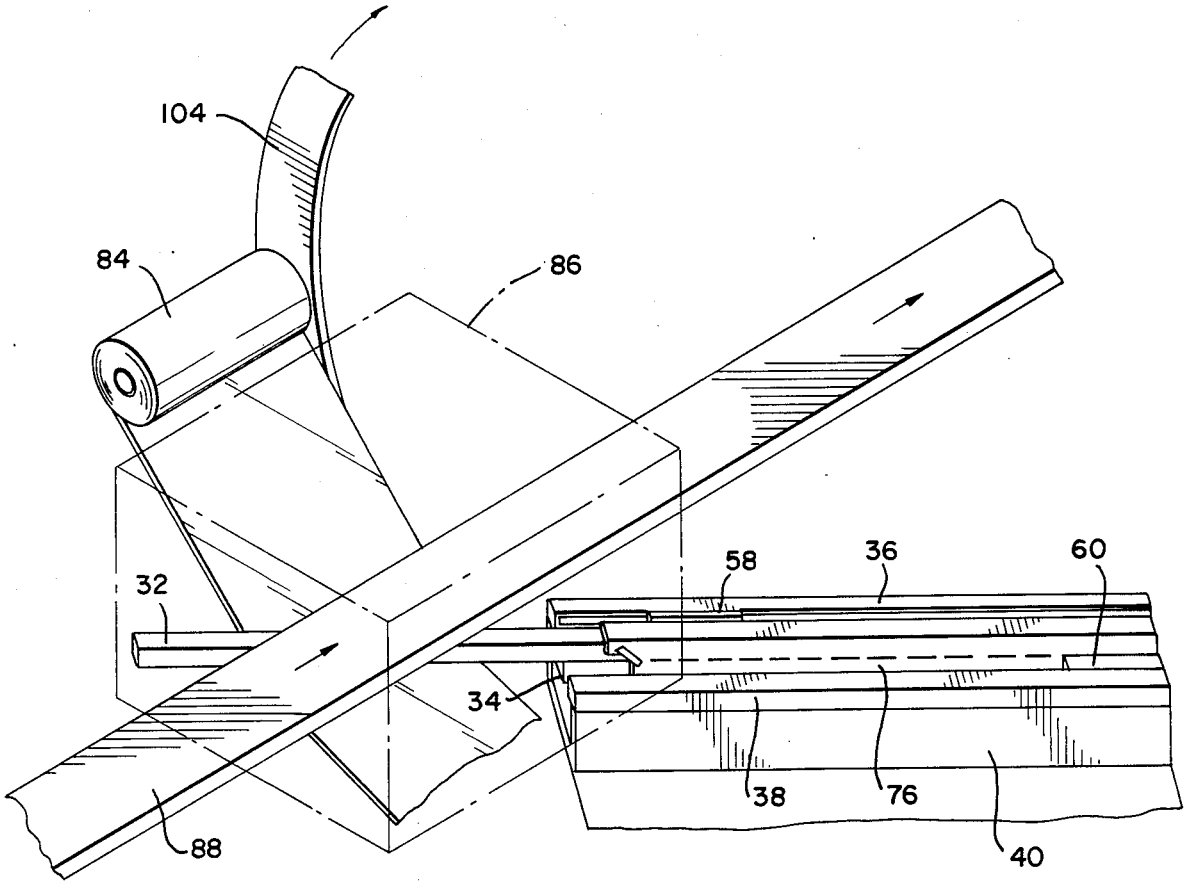
FIG. 8 is a perspective view of an alternative embodiment to the arrangement shown in FIG. 7.

The first and second clamp means may be positioned so that their longitudinal direction is oblique to the plane defined by the path of the revolving dispenser during wrapping. This may be preferable where economy of space is required. As shown in FIG. 8, the longitudinal direction of first and second clamp bars 32 and 34 is oblique to the plane defined by the path of the revolving dispenser which is shown by ring 104 and which as shown generally extends along a horizontal line projected out of the paper.

According to the present invention there is provided means for conveying the load along a direction perpendicular to the plane defined by the path of the revolving dispenser during wrapping. As shown and embodied in FIGS. 7 and 8, the means for conveying the load is a conveyor belt 88 which moves in the direction of the arrow shown in FIG. 8 which is perpendicular to the plane defined by the path of the dispenser along ring 104.

The first and second clamp means may be positioned so that their longitudinal direction is oblique to the conveying direction. As shown and embodied in FIG. 8, first and second clamp bars 32 and 34 are positioned oblique to the conveying direction of conveyor belt 88. This allows for a greater economy of space in the conveying direction.

In accordance with the present invention there is provided a method for clamping a web and wrapping a load with a web comprising: positioning a load in a position to be wrapped; rotating the load relative to a web dispenser to wrap the web on the load; extending a first longitudinally extending clamp element along its longitudinal direction into the wrapping path of the web; passing the web over the first clamp element; and subsequent to extending the first clamp element, extending a second longitudinally extending clamp element along its longitudinal direction in a direction parallel to the first clamp element to clamp the web between the first and second clamp elements as the second clamp element is longitudinally extended in a direction parallel to the longitudinal direction of the first clamp element. In accordance with an embodiment of the present invention, it is preferable that the step of extending the first clamp element occurs prior to the step of exending the second clamp element, and the step of passing the web over the first clamp element occurs subsequent to extending the first clamp element and prior to extending the second clamp element.

As shown and embodied in FIGS. 7, 8 and 4 A–E, the load is placed in a position to be wrapped by conveying load 86 on conveyor belt 88 to a position inside and aligned with ring 104. The step of rotating the load relative to a web dispenser to wrap the web on the load is performed by using ring 104 to revolve web dispenser 98 in a circle around load 86. At the beginning of each wrapping operation, the leading edge of web 82 is positioned between clamp bars 32 and 34. It is also possible to start the wrapping cycle by otherwise securing the leading edge of web 82 to the load or the conveyor 88, such as when initiating a continuous operation of wrapping a series of loads.

Figure 4A:
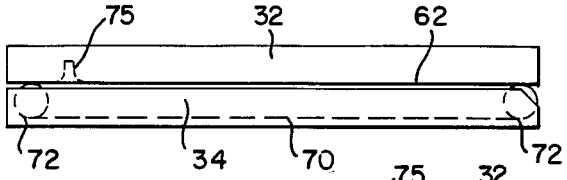
FIGS. 4A–4E are schematic left side views of the embodiment shown in FIGS. 1 and 2 executing an embodiment of a method incorporating the teachings of the present invention.
Figure 4B:
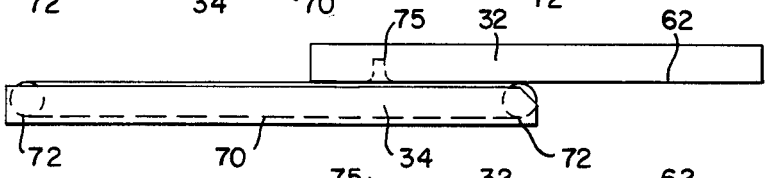
Figure 4C:
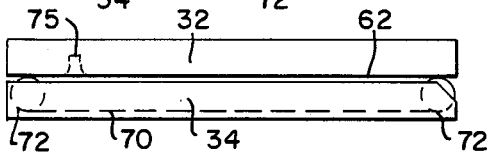

The step of extending a first longitudinally extending clamp element along its longitudinal direction into the wrapping path of the web is shown as the operation of moving first clamp bar 32 longitudinally between the positions shown in FIGS. 4A and 4B. This occurs after the load 86 and conveyor 88 have been wrapped with at least one layer of web 94 shown in FIG. 7.

The step of passing the web over the first clamp element is shown in FIG. 8 by passing the web over first clamp bar 32.

The step of subsequently extending a second longitudinally extending clamp element is shown as the operation of extending second clamp bar 34 from the position shown in FIG. 4B to the position shown in 4C. Bracket 76, being attached to second clamp bar 34, moves with and slides relative to first clamp bar 32. This sequentially and continuously clamps the web across the section of the web between first and second clamp bars 32 and 34.

In accordance with the present invention the step of extending the second clamping element includes cutting the web while clamping the web. It is also preferable that the cutting step includes sequentially and continuously clamping the web ahead of the point at which the web is being cut and that the clamping of the web occurs both in front of and behind the point at which the web is being cut. As shown in FIG. 6, the positioning of razor knife blade 80 on second clamp bar 34 and bracket 76 allows the web to be cut while second clamp bar 34 and bracket 76 are being extended. Since razor knife blade 80 is positioned near but behind the forward edge of second clamp bar 34, the clamping of the web occurs both in front of and behind the point at which the web is being cut. As a result, the web is not pulled out of position during the cutting step and is held in the position shown in FIG. 7 after the cutting step so that a new wrapping operation can proceed.

In accordance with the present invention, it is preferable that the step of extending the second clamp element includes wiping down the trailing end of the web while clamping the web. As shown and embodied in FIG. 7, the trailing end 92 of the web is wiped down with brush 90 while extending second clamp bar 34 to clamp the web.

The step of extending the first and second clamp elements may include extending those elements along the direction which is oblique to the plane defined by the path of the revolving dispenser during wrapping and oblique to the direction in which the load is conveyed. As shown and embodied in FIG. 8, first and second clamping bars 32 and 34 are extended in a direction which is oblique to the path of the dispenser 98 around ring 104 and the direction in which the load is conveyed along conveyor 88.

In accordance with the present invention, it is preferable that in a continuous operation, the wrapped load is removed from the position to be wrapped while continuing to keep the web clamped between the extended first and second clamp elements. As shown and embodied in FIGS. 7, wrapped load 86 is conveyed from the wrapping position inside ring 104. A new load to be wrapped, is conveyed on conveyor 88 into a position identical to load 86. Meanwhile, web 82 continues to be clamped between first and second clamp bars 32 and 34 which are extended in the position shown in FIG. 4C.

The step of rotating the new load relative to a web dispenser to wrap the web on the new load is accomplished by revolving film web dispenser 98 around the new load through the use of ring 104.

The second longitudinally extending clamp element is retracted along its longitudinal extent after at least one wrap of web 82 around the load so that web 82 holds against itself and no longer needs to be clamped during wrapping of the new load. This retraction step is shown and embodied as the operation of retracting second clamp bar 34 from the positions shown in FIG. 4C to that shown in FIG. 4D.

Figure 4D:
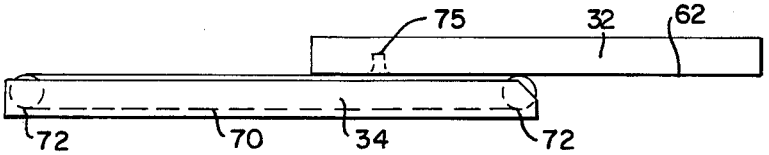
Figure 4E:
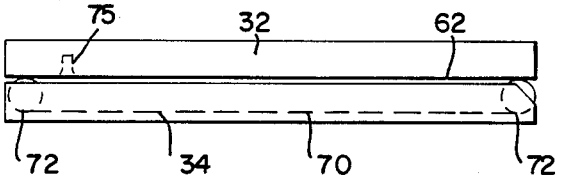

The step of retracting the first longitudinally extending clamp element along its longitudinal extent is shown as the operation of retracting first clamp bar 32 from the position shown in FIG. 4D to that shown in FIG. 4E. The load can continue to be wrapped while the first and second clamp elements are retracted as shown and embodied in the position of first and second clamp bars 32 and 34 in the retracted position of FIG. 4E. The whole cycle embodied in the step shown in FIGS. 4A–4E may continue to be executed for subsequent new loads, making the operation a continuous one.

In the preferred embodiment of the method described above, the step of retracting the second clamp element occurs prior to the step of retracting the first clamp element and is shown and embodied in FIGS. 4A–4E as independently moving first and second clamp bars 32 and 34 as described.

In accordance with the second preferred method, the steps of extending and retracting the first clamp element and the second clamp element preferably occur simultaneously. As shown and embodied in FIGS. 5A–5C, first and second clamp bars 32*a* and 34*a* include belts 66*a* and 70*a* and first and second clamp bars 32*a* and 34*a* extend simultaneously in the operation occurring from FIGS. 5A to 5B, and retract simultaneously in the operation from FIGS. 5B to 5C.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the general inventive concept as defined by the appended claims and their equivalents.

What is claimed is:

1. A clamp comprising:

a first longitudinally extending clamp means including first contact means for contacting a workpiece;

a second longitudinally extending clamp means extendable in a direction parallel to the longitudinal direction of the first clamp means, the second clamp means including second contact means opposed to the first contact means for contacting the workpiece, the second contact means being supported by a remaining portion of the second clamp means and movable in the longitudinal direction relative to the remaining portion of the second clamp means while being fixed relative to the first contact means for clamping a workpiece between the second contact means and the first contact means as the remaining portion of the second clamp means is longitudinally extended in a direction parallel to the longitudinal direction of the first clamp means.

2. The clamp of claim 1 wherein the remaining portion of the second clamp means is extendable relative to the first clamp means for clamping the workpiece between the second clamp means and first clamp means when the remaining portion of the second clamp means is extended relative to the first clamp means.

3. The clamp of claim 1 including a base means for supporting and cantilevering the first and second clamp means.

4. The clamp of claim 3 wherein the first clamp means has a remaining portion for supporting the first contact means and the remaining portions of the first and second clamp means are simultaneously extendable relative to the base means for clamping the workpiece between the second contact means and the first contact means when the remaining portions of the first and second clamp means are simultaneously extended in the same direction.

5. The clamp of claim 1 wherein the first and second contact means sequentially clamp the workpiece across a section of the workpiece.

6. The clamp of claim 1 wherein the first and second contact means continuously clamp the workpiece across a section of the workpiece.

7. The clamp of claim 1 wherein the first and second contact means sequentially and continuously clamp the workpiece across a section of the workpiece.

8. The clamp of claim 1 wherein the first and second clamp means are slender members.

9. The clamp of claim 3 including means for orienting and forcing the first and second clamp means together.

10. The clamp of claim 9 wherein a portion of the orienting and forcing means is located proximate to the cantilevered end of the second clamp means.

11. The clamp of claim 9 wherein the orienting and forcing means is a bracket.

12. The clamp of claim 11 wherein the bracket is secured to the remaining portion of the second clamp means and slidable relative to the first clamp means.

13. The clamp of claim 12 wherein the bracket is C-shaped.

14. The clamp of claim 1 wherein the first contact means includes a resilient material.

15. The clamp of claim 14 wherein the first contact means is fixed relative to the remaining portion of the first clamp means.

16. The clamp of claim 1 wherein the second contact means is a belt.

17. The clamp of claim 15 wherein both the first contact means and the second contact means are belts.

18. The clamp of claim 17 wherein each of the belts is movable relative to the remaining portion of its respective clamp means.

19. The clamp of claim 16 wherein the second contact means belt is secured to the first clamp means.

20. The clamp of claim 16 wherein the second contact means belt doubles back on journals at each end of the second clamp means.

21. The clamp of claim 3 including cutting means mounted proximate to the cantilevered end of the second clamp means for cutting the workpiece while clamping the workpiece.

22. The clamp of claim 1 including cutting means mounted proximate to the cantilevered end of the second clamp means for cutting the workpiece while clamping the workpiece.

23. The clamp of claim 3 including wipe down means mounted near the cantilevered end of the second clamp means for wiping down the workpiece while clamping the workpiece.

24. The clamp of claim 21 including wipe down means mounted near the cantilevered end of the second clamp means for wiping down the workpiece while clamping the workpiece.

25. Apparatus for clamping a web and wrapping a load with the web comprising:

means for dispensing the web;

means for rotating the load relative to the dispenser means to wrap the web on the load; and means for clamping the web including a first longitudinally extending clamp means having first contact means for contacting the web, a second longitudinally extending clamp means extendable in a direction generally parallel to the longitudinal direction of the first clamp means, the second clamp means including second contact means opposed to the first contact means for contacting the workpiece, the second contact means being supported by a remaining portion of the second clamp means and movable in the longitudinal direction relative to the remaining portion of the second clamp means while being fixed relative to the first contact means for clamping the web between the second contact means and the first contact means as the remaining portion of the second clamp means is longitudinally extended in a direction parallel to the longitudinal direction of the first clamp means.

26. The apparatus of claim 25 wherein the means for rotating the load relative to the dispenser means includes means for revolving the dispenser means around the load.

27. The apparatus of claim 26 wherein the first and second clamp means are positioned so that their longitudinal direction is oblique to the plane defined by the path of the revolving dispenser during wrapping.

28. The apparatus of claim 26 including means for conveying the load along a direction perpendicular to the plane defined by the path of the revolving dispenser during wrapping.

29. The apparatus of claim 28 wherein the longitudinal extent of the first and second clamp means is positioned oblique to the conveying direction.

30. The apparatus of claim 25 including cutting means mounted near the cantilevered end of the second clamp means for cutting the workpiece while clamping the workpiece.

31. The apparatus of claim 25 including wipe down means mounted near the cantilevered end of the second clamp means for wiping down the workpiece while clamping the workpiece.

32. A method for clamping a web and wrapping a load with a web comprising:

positioning a load in a position to be wrapped;

rotating the load relative to a web dispenser to wrap the web on the load;

extending a first longitudinally extending clamp element along its longitudinal direction into the wrapping path of the web;

passing the web over the first clamp element and contacting the web with a contact portion of the first clamp element; and extending a second longitudinally extending clamp element along its longitudinal direction in a direction parallel to the first clamp element and contacting the web with a contact portion of the second clamp element while moving the contact portion of the second clamp element in the longitudinal direction relative to a remaining portion of the second clamp element but maintaining the contact portion of the second clamp element fixed relative to contact portion of the first clamp element to clamp the web between the contact portions of the first and second clamp elements as the remaining portion of the second clamp element is longitudinally extended in a direction parallel to the longitudinal direction of the first clamp element.

33. The method of claim 32 wherein the step of extending the first clamp element occurs prior to the step of extending the second clamp element, and the step of passing the web over the first clamp element occurs subsequent to extending the first clamp element and prior to extending the second claim element.

34. The method of claim 32 wherein the step of extending the first clamp element and the step of extending the second clamp element occur simultaneously.

35. The method of claim 32 including removing the wrapped load from the position to be wrapped while continuing to keep the web clamped between the extended first and second clamp elements;

positioning a new load in the position to be wrapped;

rotating the new load relative to a web dispenser to wrap the web on the new load;

after at least one wrap, retracting the second longitudinally extending clamp element along its longitudinal direction, retracting the first longitudinally extending clamp element along its longitudinal direction; and continuing to wrap the web on load while the first and second clamp elements are retracted.

36. The method of claim 35 wherein the step of retracting the second clamp element occurs prior to the step of retracting the first clamp element.

37. The method of claim 35 wherein the step of retracting the second clamp element and the step of retracting the first clamp element occur simultaneously.

38. The method of claim 32 wherein the step of extending the second clamp element includes sequentially clamping the web across a section of the web.

39. The method of claim 32 wherein the step of extending the second clamp element includes continuously clamping the web across a section of the web.

40. The method of claim 32 wherein the step of extending the second clamp element includes sequentially and continuously clamping the web across a section of the web.

41. The method of claim 32 wherein the step of extending the second clamping element includes cutting the web while clamping the web.

42. The method of claim 41 wherein the cutting step includes sequentially and continuously clamping the web ahead of the point at which the web is being cut.

43. The method of claim 41 wherein the clamping of the web occurs both in front of and behind the point at which the web is being cut.

44. The method of claim 32 wherein the step of extending the second clamp element includes wiping down the trailing end of the web while clamping the web.

45. The method of claim 41 wherein the step of extending the second clamp element includes wiping down the trailing end of the web while clamping the web.

46. The method of claim 32 including removing the wrapped load from the wrapping position, placing a new load in the wrapping position, wrapping the web around the new load, and retracting the second clamp element from the path of the web.

47. The method of claim 32 wherein the rotating step includes revolving the web dispenser around the load.

48. The method of claim 47 wherein the step of extending the first and second clamp elements includes extending those elements along a direction which is oblique to the plane defined by the path of the revolving dispenser during wrapping.

49. The method of claim 47 wherein the step of positioning and removing the load includes conveying the load in a direction perpendicular to the plane defined by the path of the revolving dispenser during wrapping.

50. The method of claim 49 wherein the step of extending the first and second clamp elements includes extending those elements along a direction which is oblique to the direction in which the load is conveyed.

* * * * *